United States Patent [19]

Stover

[11] 3,930,466

[45] Jan. 6, 1976

[54] SEGMENTED GATE DEVELOPER FLOW CONTROLLER

[75] Inventor: Raymond W. Stover, Webster, N.Y.

[73] Assignee: Xerox Corporation, Stamford, Conn.

[22] Filed: Apr. 29, 1974

[21] Appl. No.: 464,865

[52] U.S. Cl. ..... 118/637; 427/18

[51] Int. Cl.[2] ..... G03G 15/08

[58] Field of Search..... 118/636, 637, DIG. 24; 117/17.5; 222/DIG. 1, 544, 556, 557, 560; 355/3 DD

[56] References Cited

UNITED STATES PATENTS

| | | | |
|---|---|---|---|
| 3,648,656 | 3/1972 | Ogawa | 118/637 |
| 3,712,266 | 1/1973 | Stauffer | 118/636 |
| 3,717,122 | 2/1973 | Hudson | 118/636 |
| 3,724,422 | 4/1973 | Latone et al. | 118/637 |
| 3,753,420 | 8/1973 | Post et al. | 118/637 |

OTHER PUBLICATIONS

IBM, Tech. Disc., Vol. 15, No. 4, Sept. 72, "Magnetic Brush Unit W. Magnetic Conveyor," by Freeman et al.

*Primary Examiner*—Mervin Stein
*Assistant Examiner*—Douglas Salser
*Attorney, Agent, or Firm*—James J. Ralabate; Sheldon F. Raizes

[57] ABSTRACT

An apparatus is provided which limits the amount of developer that is presented to an electrostatic latent image to a width corresponding to the length of copy paper used. This particular apparatus and method apply to a development system which has a developer sump communicated to a magnetic transport means through a developer outlet at the lower end of the sump. During development functions, magnetic developer flows from the sump through the outlet to the magnetic transport means to be presented to the latent image. A plurality of magnetic gates are provided, each of which; may be swung into closed position adjacent the outlet to magnetically block flow of developer through that portion of the outlet corresponding to the length of the magnetic gate adjacent thereto. Each magnetic gate may also be swung into an open position which allows developer to flow through the outlet corresponding to the length of the magnetic gate adjacent thereto. Certain of the magnetic gates may be selectively located in open or closed position to allow developer to flow through the outlet over a length corresponding to the length of a copy sheet being utilized. All of the gates may be located in closed position when it is desired to stop all of developer flow through the outlet to puurge the developer systems.

5 Claims, 3 Drawing Figures

SEGMENTED GATE DEVELOPER FLOW CONTROLLER

This application is related to U.S. application Ser. No. 464,862, filed Apr. 29, 1974, and U.S. application Ser. No. 464,863, filed Apr. 29, 1974, each of which are copending and commonly assigned.

DESCRIPTION OF INVENTION

In an electrostatic copier system, it has been found that developer (carrier and toner particles) life is related to the function of the number of times the developer is cycled through the development system; the more times cycled, the shorter the life.

In known systems, it is the custom to present developer to a photoconductive surface carrying a latent image over the same width regardless of the size of the final image desired. For instance, developer may be presented to a surface carrying a latent image over a 14-inch bandwidth for copying an image onto either an 11 × 14-inch paper or an 8½ × 11-inch paper. The bandwidth coincides with the length of the paper as the paper is fed through the machine. For the latter size paper, developer is presented to a latent image over an extra 3-inch bandwidth and is therefore needlessly circulated with resultant shortening of developer life.

It is therefore an object of this invention to stop needless circulation of excess developer and thus improve developer life.

It is a further object of this invention to limit developer presentation to a surface carrying a latent image over a bandwidth equal to the length of paper on which the developed image is to be transferred.

Other objects of the invention will become apparent from the following description with reference to the drawing wherein.

Figure 1:
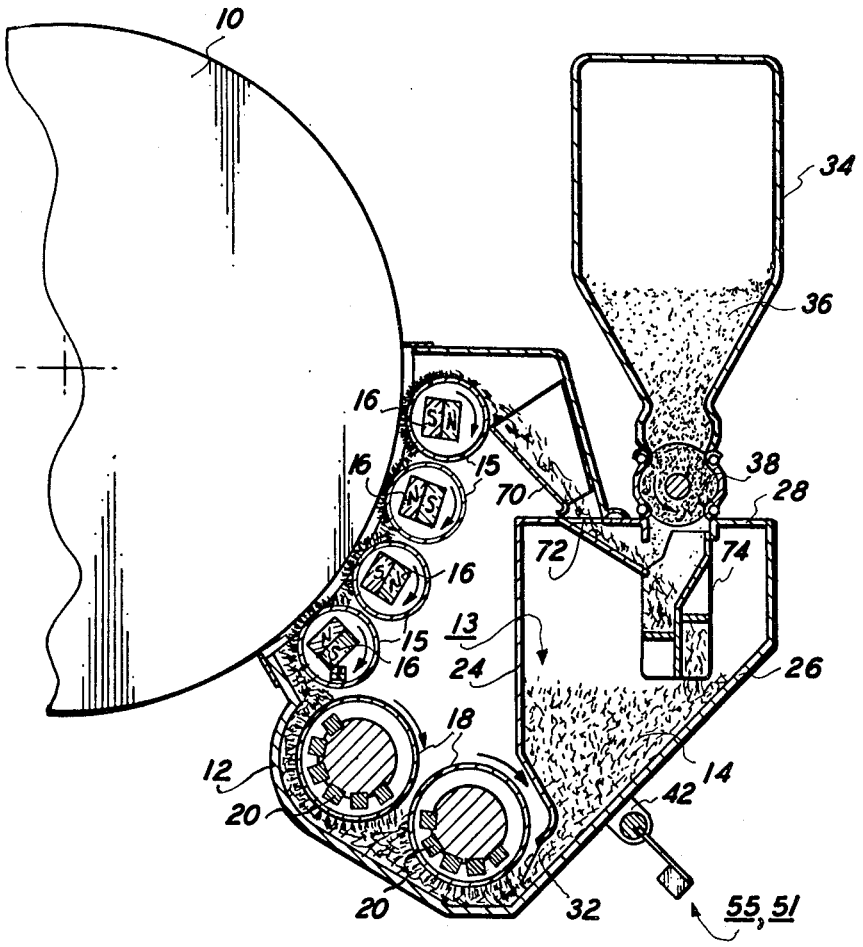
FIG. 1 is a cross-sectional view of a development system illustrating a magnetic gate in open position.

Referring to FIG. 1, there is illustrated a rotatable drum 10 having a photoconductive surface thereon and a developer housing 12 located adjacent to the drum. The photoconductive surface is adapted to receive an electrostatic latent image thereon. The developer housing includes a developer sump 13 having a quantity of developer 14 therein. The developer 14 comprises toner particles and ferromagnetic carrier particles. Assuming a positive development system, the triboelectric characteristics of these particles are such that the toner particles will be triboelectrically attracted to the carrier particles and the charge on the toner particles will be opposite to the charge of the latent image. A plurality of "magnetic brush" rollers 15 are rotatably mounted on the side walls of the developer housing 12 and are located contiguous to the photoconductive surface 10. The rollers 15 are constructed of non-magnetic material and each surround a stationary permanent magnet 16. The magnets 16 are arranged to effect a magnetic field for attracting the developer onto the rollers 15 and to present toner particles to a latent image carried by the photoconductive surface. A pair of "magnetic transport" rollers 18, constructed of non-magnetic material, are rotatably mounted to the side walls of the developer housing below the magnetic brush rollers 15. A plurality of magnets 20 are located within each roller 18 and are so positioned to set up a magnetic field for attracting the magnetic developer onto the transport rollers to transport the same to the magnetic brush rollers.

The developer sump 13 comprises a front wall 24 separating the sump from the rollers 15 and 18, a rear sloping wall 26 and upper wall 28, each of which are of non-magnetic material. A developer outlet 32 is located at the lowermost portion of the developer sump 13 for allowing developer to flow from the sump to the transport rollers 18. Affixed to the upper wall 28 is a toner dispenser 34 having toner particles 36 therein which are periodically dispensed into the developer sump 13 by a rotatable foam roller 38. A pair of spaced brackets 40 and 42 extend from the rear wall 26 of the sump 13.

A pair of telescoping shafts 44 and 46 are rotatably supported by the brackets 40 and 42. The shaft 44 is tubular and receives the shaft 46, which is solid, therein. One end of the shaft 44 extends through an opening in the bracket 42 to be rotatably supported thereby and one end of the shaft 46 extends through the bracket 40 to be rotatably supported thereby. The other or free ends of each shaft take support on the opposite shaft. Two magnetic end gates 51 are provided, each comprising a plate 52 secured at one end to the shaft 44 at a respective end thereof and a permanent magnet 54 secured to the other end of each plate. A magnetic center gate 55 is located between the end gates 51 and comprises a plate 56 secured to the inner shaft 46 at one end thereof and has secured thereto a magnetic bar 58 at the other end thereof. An opening 60 is formed in a portion of the hollow shaft 44 to allow the plate 56 to extend from the shaft 46 through the tubular shaft 44 and to permit a given rotation of the center gate 55.

Figure 2:
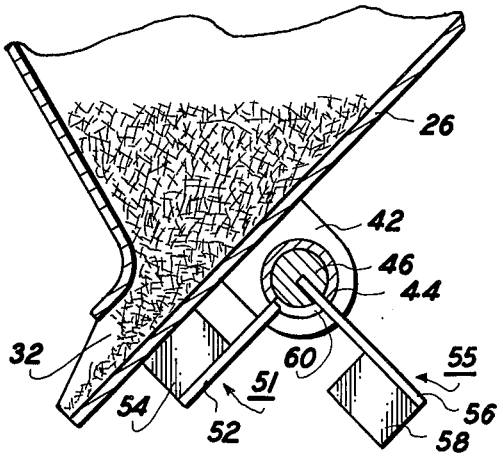
FIG. 2 is a partial view of FIG. 1 showing a portion of the magnetic gate in closed position.
Figure 3:
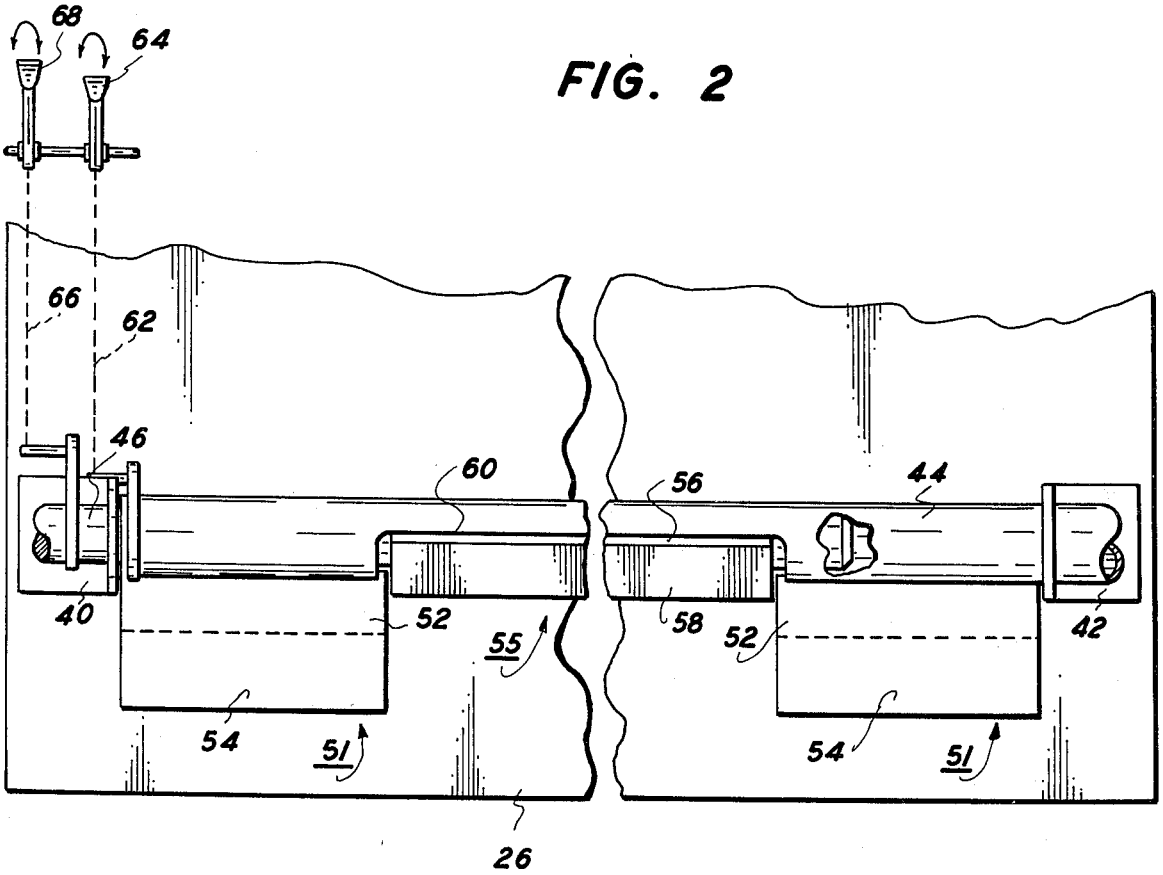
FIG. 3 is a rear view of the magnetic gate in the same position as in FIG. 2.

The shaft 44 is connected through a mechanical linkage 62 to a hand lever 64 which is located on the machine at a location readily accessible to an operator. The shaft 46 is connected through a mechanical linkage 66 to a hand lever 68 which is also at a location on the machine which is readily accessible to the operator and adjacent to the lever 64. Upon moving the lever 64 in one direction, the shaft 44 will be rotated by the linkage 62 in a clockwise direction (FIG. 2) to move the end magnetic gates 55 into closed position with magnets 54 engaging the rear wall 26 of the sump 13 adjacent the developer sump outlet 32. Upon moving the lever 68 in one direction, the shaft 46 will be rotated by the linkage 66 in a clockwise direction (FIG. 2) to move the center magnetic gate 55 into closed position with magnet 58 engaging the rear wall 26 of the sump 13 adjacent the developer sump outlet 32. Movement of the levers 64 and 68 in the opposite direction will result in moving the magnetic gates away from the sump outlet 32 into open position.

The axial width of the photoconductor drum is about 14 inches which accommodates copying onto a 14-inch long or a shorter sheet of paper. The center gate 55 is approximately 11 inches in axial length and the two end gates are each approximately 1½ inches long bringing the combined length of the gates 51 and 55 to 14 inches. When all of the magnetic gates 51 and 55 are in open position, developer 14 is free to flow from the sump through the entire axial length of outlet 32 to the transport rollers 18. When the magnetic gates 51 are in closed position, the ferromagnetic developer particles 14 are trapped within the magnetic field of the magnets 54 thus blocking flow thereof through the outlet 32 in the region corresponding to the length of the magnets 54. Thus developer will flow only through the outlet gate 55. Normally, the lever 68 is in a center gate 55 open position. If an 11-inch copy sheet is desired, the lever 64 may be operated to close the magnetic gates 51 whereby developer will be transported to the magnetic brush rolls 15 only across an 11-inch width. This is very desirous since developer life is a function of developer circulation through the development system with the life increasing upon a decrease in the number of times circulated. Obviously, if a 14-inch band of developer is presented to an 11-inch image, a 3-inch bandwidth of developer is circulated needlessly thereby decreasing the developer life. If a 14-inch copy sheet is desired, the lever 64 may be operated to open the magnetic gates 51 allowing the developer to be transported to the magnetic brush rolls 15 across a 14-inch width. If it is desired to purge the development system, the levers 64 and 68 are moved to gate closed position thereby closing the gates 51 and 55 across the entire length of the outlet 32 to magnetically block the flow of developer from the sump 13 to the transport rolls 18.

A chute 70 is located between the uppermost magnetic brush roller 15 and a residual developer opening 72 in the upper wall 28 of the developer sump 13 to direct residual developer material from the uppermost roll 15 into the sump 13. A passive cross mixer 74 is located immediately below the residual developer opening 72 and the toner dispenser 34 to receive the residual developer and fresh toner theron and effect mixing thereof prior to discharging the same into the lower end of the developer sump 13.

In operation, an electrostatic latent image is formed on the photoconductive surface 10 in the customary manner as the drum rotates past an imaging station (not shown). For a 14-inch copy, the magnetic gates 51 and 55 are in the open position as shown in FIG. 1 which allows the developer to flow from the sump 13 through the outlet 32 to the magnetic transport rollers 18. The developer is carried by the magnetic transport rollers 18 to the magnetic brush rollers 15 whereby the toner particles in the developer material are presented to the latent image over a 14-inch bandwidth to develop the same as the latent image on the photoconductive surface is brought therepast. The developed image is then transferred to a copy sheet by well-known methods. Residual developer is carried to the uppermost magnetic brush roller 15 whereby upon movement of the developer out of the magnetic field of the magnet surrounded by such roller the developer is allowed to drop by gravity down the chute 70 to the residual developer opening 72 onto the cross mixer 74. Fresh toner 36 is dispensed onto the cross mixer 74 by the foam roller 38 to be mixed with the residual developer and the developer is discharged from the cross mixer to the lower end of the sump 13. This process continues through each development function. When it is desired to use an 11-inch copy sheet, the lever 64 is actuated to close the gates 51 thus limiting developer flow through the outlet 32 to an 11-inch band whereby the toner particles in the developer material are presented to the latent image over an 11-inch bandwidth preventing needless circulation of excess developer.

It is customary to move the developer housing 12 away from the photoconductor drum 10 in order to repair elements on the developer housing or for replacing the photoconductor drum. Before doing this, it is most desirable to purge the system of developer to prevent developer from contaminating the rest of the machine. To do this, the levers 64 and 68 are moved to close the gates 51 and 55. The ferromagnetic developer particles are trapped within the magnetic field of the magnets 54 and 58 and thereby block further flow of the developer material through the outlet 32 from the sump to the transport rollers 18. Continued rotation of the transport rollers 18 and the magnetic brush rollers 15 delivers the developer within that portion of the developer housing to the uppermost roller 15 whereby it is discharged from the uppermost roller 15 onto the chute 70 and back into the developer sump 13 thereby purging the system of developer. After the system is purged, the developer housing 12 may be moved away from the photoconductor 10 with little chance of developer material contaminating the machine.

It is obvious that the end gates 51 could be connected to shaft 46 and the center gate 55 could be connected to shaft 44 with suitable modifications. Also it is obvious that the above embodiment could be modified by providing more magnetic gates and split shafts to accommodate various copy paper sizes. Furthermore the levers 64 and 68 could be remotely controlled by a copy paper size sensing mechanism.

What is claimed is:

1. In a development system: a surface capable of having a developable image thereon; a developer sump; said sump having ferromagnetic developer therein; magnetic means for presenting said developer to said surface; a developer outlet at the lowermost portion of said sump; said developer flowing through said outlet to said means for presenting said developer to said surface; magnetic gate means comprising at least two gates, each having a permanent magnet; means for selectively moving each said magnetic gate independently of each other into a closed position adjacent said outlet to block the flow of developer through a portion of said outlet corresponding to the gate thereadjacent and for selectively moving each said magnetic gate independently of each other away from said outlet to an open position to allow flow of developer through said portion of said outlet corresponding to a respective said gate.

2. The structure as recited in claim 1 further comprising means mounting each of said magnetic gates for pivotal movement between said open and closed positions.

3. The structure as recited in claim 2 wherein said surface is a photoconductive surface and said developer comprises toner particles and ferromagnetic carrier particles.

4. The structure as recited in claim 3 wherein said magnetic means for presenting developer comprises rotatable rollers of non-magnetic material, each surrounding a magnetic member.

5. The structure as recited in claim 1 wherein remote control means are operatively connected to said means for selectively moving each said magnetic gate independently of each other.

* * * * *